US005826642A

United States Patent [19]

Brophy

[11] Patent Number: 5,826,642

[45] Date of Patent: Oct. 27, 1998

[54] ROTARY REGENERATIVE HEAT EXCHANGER

[75] Inventor: Mark E. Brophy, Wellsville, N.Y.

[73] Assignee: ABB Air Preheater, Inc., Wellsville, N.Y.

[21] Appl. No.: 22,175

[22] Filed: Feb. 11, 1998

[51] Int. Cl.[6] ..... F28F 7/00

[52] U.S. Cl. ..... 165/76; 165/10; 165/8

[58] Field of Search ..... 165/10, 8, 6, 4, 165/76

[56] References Cited

U.S. PATENT DOCUMENTS

| | | | |
|---|---|---|---|
| 4,552,204 | 11/1985 | Bellows | 165/8 X |
| 5,119,885 | 6/1992 | Johnson | 165/8 |
| 5,454,418 | 10/1995 | Brophy et al. | 165/8 |
| 5,615,732 | 4/1997 | Brophy et al. | 165/8 |
| 5,664,620 | 9/1997 | Ritter | 165/8 |
| 5,713,411 | 2/1998 | Fierle | 165/8 |

*Primary Examiner*—Ira S. Lazarus
*Assistant Examiner*—Christopher Atkinson
*Attorney, Agent, or Firm*—Alix, Yale & Ristas, LLP

[57] ABSTRACT

The heat exchange baskets for a rotary regenerative air preheater are loaded radially into the rotor rather than axially from the duct end. The rotor is divided into sectors by diaphragms, and support gratings are provided in each rotor sector with the baskets being positioned and supported on the gratings. The baskets are removed from the rotor with a removal lug or tool which includes a lever portion and a hook portion with a beveled edge. The beveled edge and then the entire hook portion are inserted under the outer edge of a basket and then rotated with the lever portion whereby the hook portion engages the basket. The lug or tool is then pulled outwardly to remove the basket.

2 Claims, 5 Drawing Sheets

ROTARY REGENERATIVE HEAT EXCHANGER

BACKGROUND OF THE INVENTION

The present invention relates generally to rotary regenerative heat exchangers and, more specifically, to improved means for removing modular heat exchange baskets from the rotor.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heat absorbent material enters the passageway for the cold gas stream where the heat is transferred from the absorbent material to the cold gas stream.

In a typical rotary heat exchanger, such as a rotary regenerative air preheater, the cylindrical rotor is disposed on a vertical central rotor post and divided into a plurality of sector-shaped compartments by a plurality of radial partitions or diaphragms extending from the rotor post to the outer peripheral shell of the rotor. These sector-shaped compartments are loaded with modular heat exchange baskets which contain the mass of heat absorbent material commonly comprised of stacked plate-like elements.

The rotor is surrounded by a housing and the ends of the rotor are partially covered by sector plates located between the gas inlet and outlet ducts which divides the housing into hot gas and cold gas sides. In order to improve the efficiency of operation, it is conventional to provide seals, which are referred to as radial seals, on the ends of the rotor such that the seals will come into proximity with the sector plates and minimize the flow of gases between the hot and cold sides at the ends of the rotor. These seals are normally attached to the edges of the diaphragms.

One type of modular heat exchange basket comprises an open frame and does not have solid side walls. These baskets are loaded axially into the rotor from the top end (duct end) and stay plates are located between and support radially adjacent baskets. To ensure that the baskets can be freely inserted, it is necessary to have the baskets undersized as compared to the compartments formed by the diaphragms and stay plates so that there is a clearance. Therefore, in order to provide the necessary heat exchange surface, it is necessary to have excess frontal area and consequently a larger rotor. Also, gaps exist around each basket permitting the bypass of the air and flue gas thus reducing the thermal efficiency.

In another arrangement, the rotor is constructed for the loading and removal of the baskets in a radial direction through the side of the rotor rather than axially through the duct end. The baskets may be positioned and supported in each sector so that they also act as supports between diaphragms and serve to stiffen the rotor structure while reducing bypass gaps. The baskets are supported on gratings fixed between diaphragms at each end of the rotor and between layers of baskets. If the baskets also act as supports between the diaphragms, the angle of each rotor sector is smaller than the complimentary angle of each basket such that the outboard end of each basket can contact the diaphragms before the contact of the inboard end.

A problem that exists with side removal baskets, particularly those that contact the diaphragms, is that the baskets can be difficult to remove for inspection or for replacement with new basketed heat transfer surface. Removal requires that the baskets slide over the support gratings and removal is complicated by limited access. There is usually only one quarter to one half inch vertical clearance. In addition, if the baskets are pulled from any place other than the extreme lower edge, the baskets have a tendency to tip into the grating support bars and hang up.

SUMMARY OF THE INVENTION

The present invention relates to a novel method for removing heat exchange baskets in a radial direction through the sides of a rotary regenerative air preheater. The method involves the insertion of a lug device under the lower outer edge of the baskets to lift the outer edge of the baskets a limited distance, rotation of the lug device to hook the baskets and then pulling the lug device to pull the baskets out of the rotor.

DESCRIPTION OF THE PREFERRED EMBODIMENT

Figure 1:
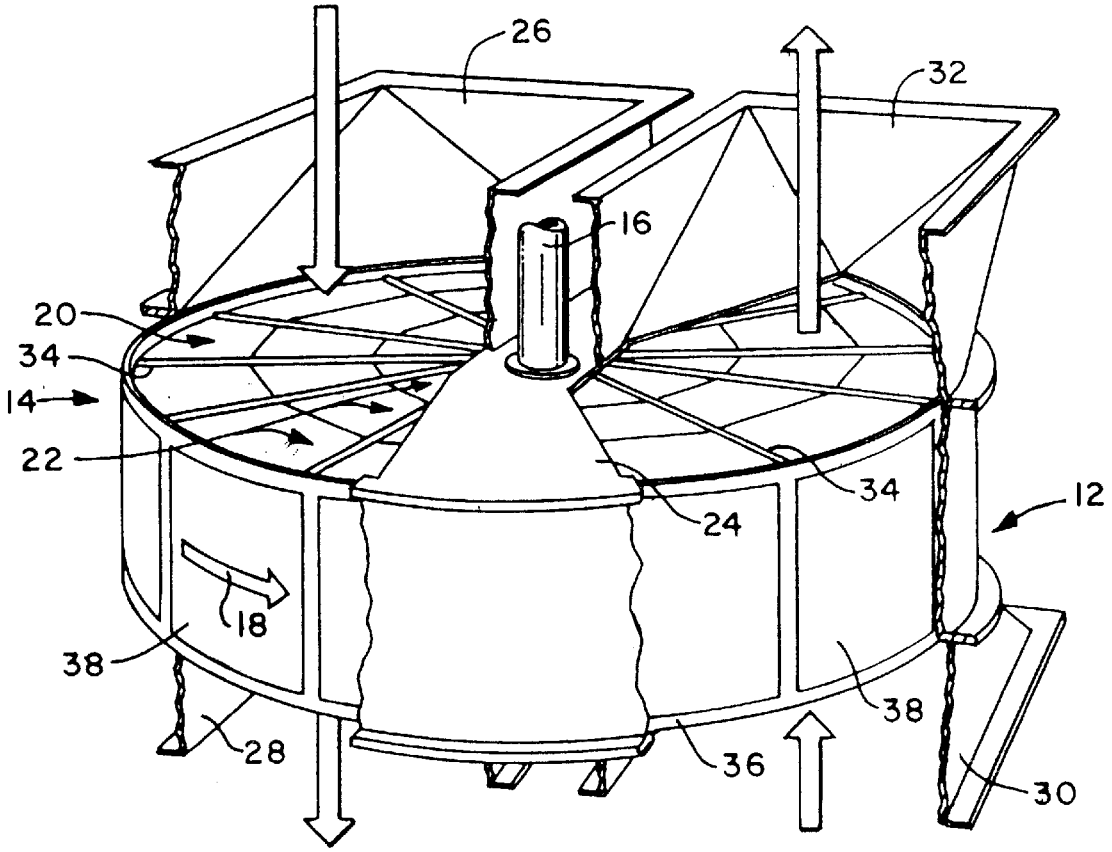
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32. The basket modules 22 are loaded into the rotor 14 through the rotor shell 36 by removing the cover plates 38 and sliding the baskets radially into each sector 20.

Figure 2:
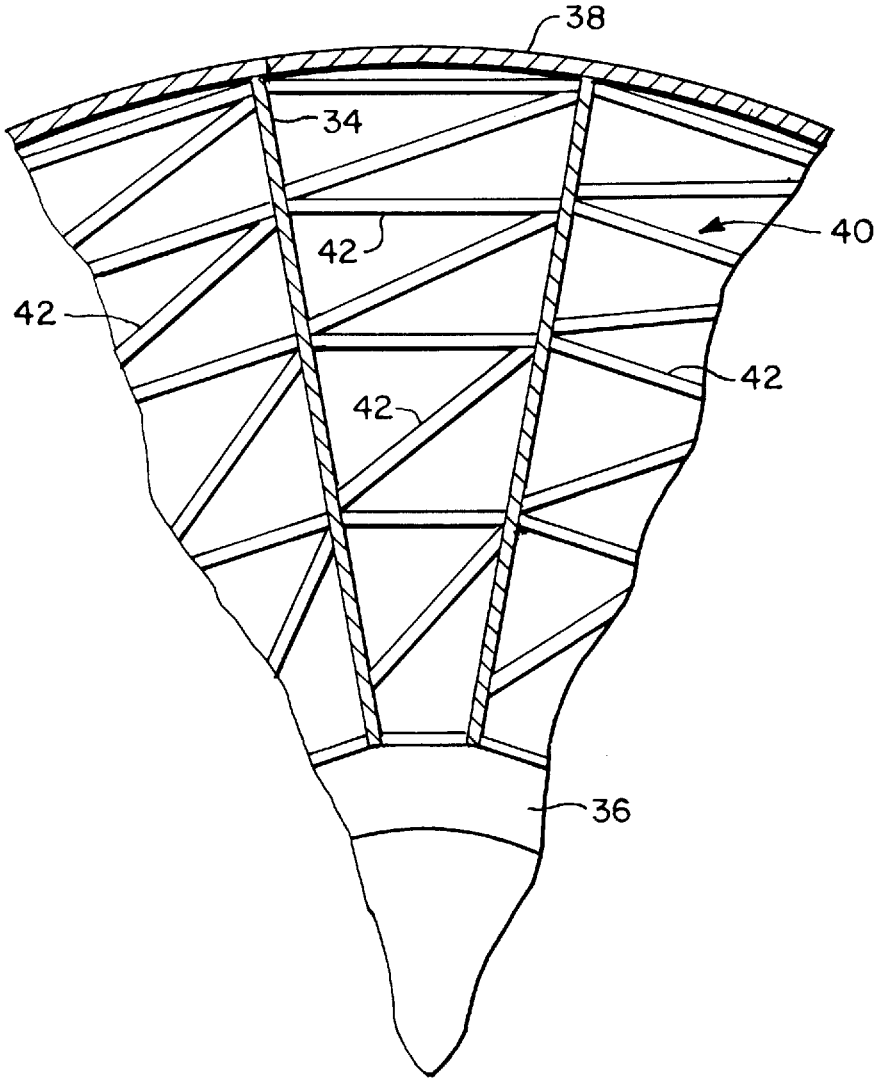
FIG. 2 is a top cross section view of a portion of the rotor of the preheater of FIG. 1 illustrating the support gratings in position between diaphragms.

Referring now to FIG. 2 which shows a plan view in cross section of a portion of a rotor, the diaphragms 34 are shown in cross section extending radially between the central portion 36 of the rotor and the rotor shell 38. This FIG. 2 is a view before the basket modules have been installed. Supported between and attached to the diaphragms 34 are the support gratings 40. These support gratings are formed from the members 42 and are normally truss-like structures. Any desired truss configuration can be used as long as it is structurally designed to support the baskets. The gratings are suitably attached to the diaphragms 34 such as by welding. As is conventional, there are a plurality of levels of gratings in each sector.

The baskets of the present invention are placed into the rotor through the sides or the periphery of the rotor rather than from the top end of the rotor. When baskets are loaded from the top, sufficient clearance must be provided and stay plates are located between radially adjacent baskets to hold them in place. The clearance around each basket means that the air preheater will require additional frontal (end) area in order to accommodate a certain amount of heat transfer surface. When the baskets are loaded from the side, very little clearance is needed and they can be fitted tightly into the sections and against each other so that most clearances are eliminated. This eliminates the need for stay plates and reduces the required frontal area of the air preheater needed for a specific amount of heat transfer surface.

Figure 3:
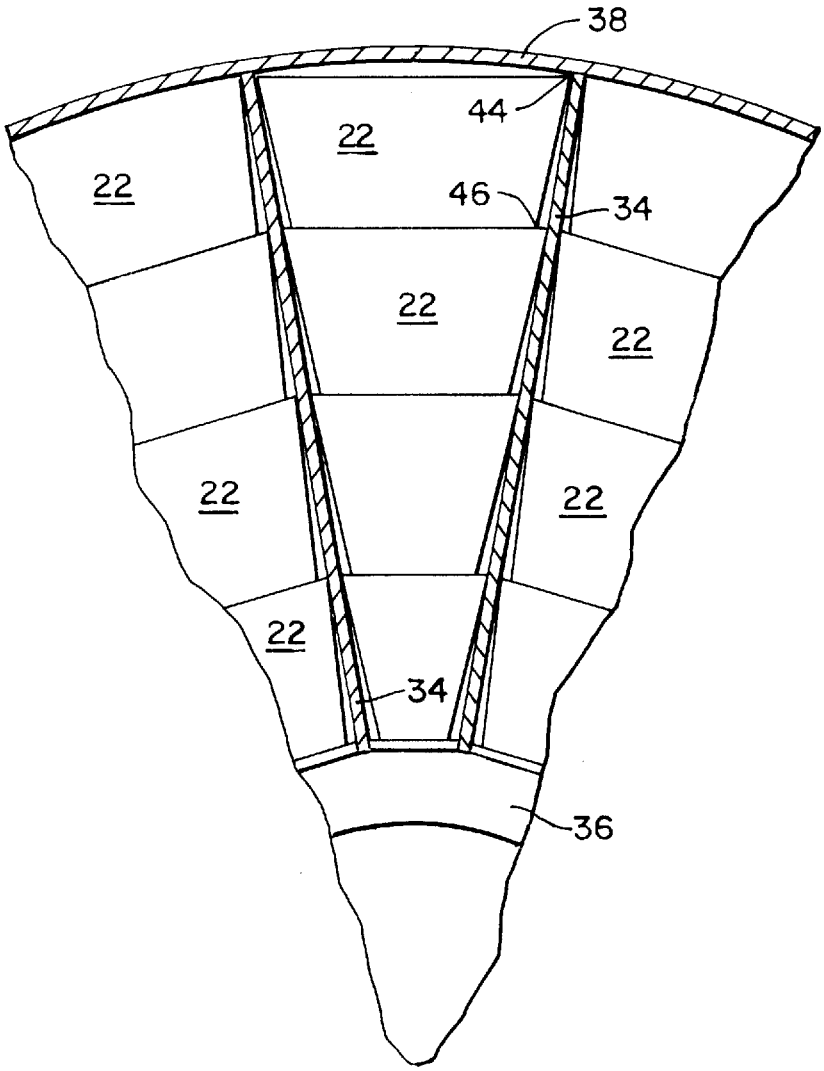
FIG. 3 is a similar top cross section view of a portion of the preheater of FIG. 1 illustrating the baskets in position.
Figure 4:
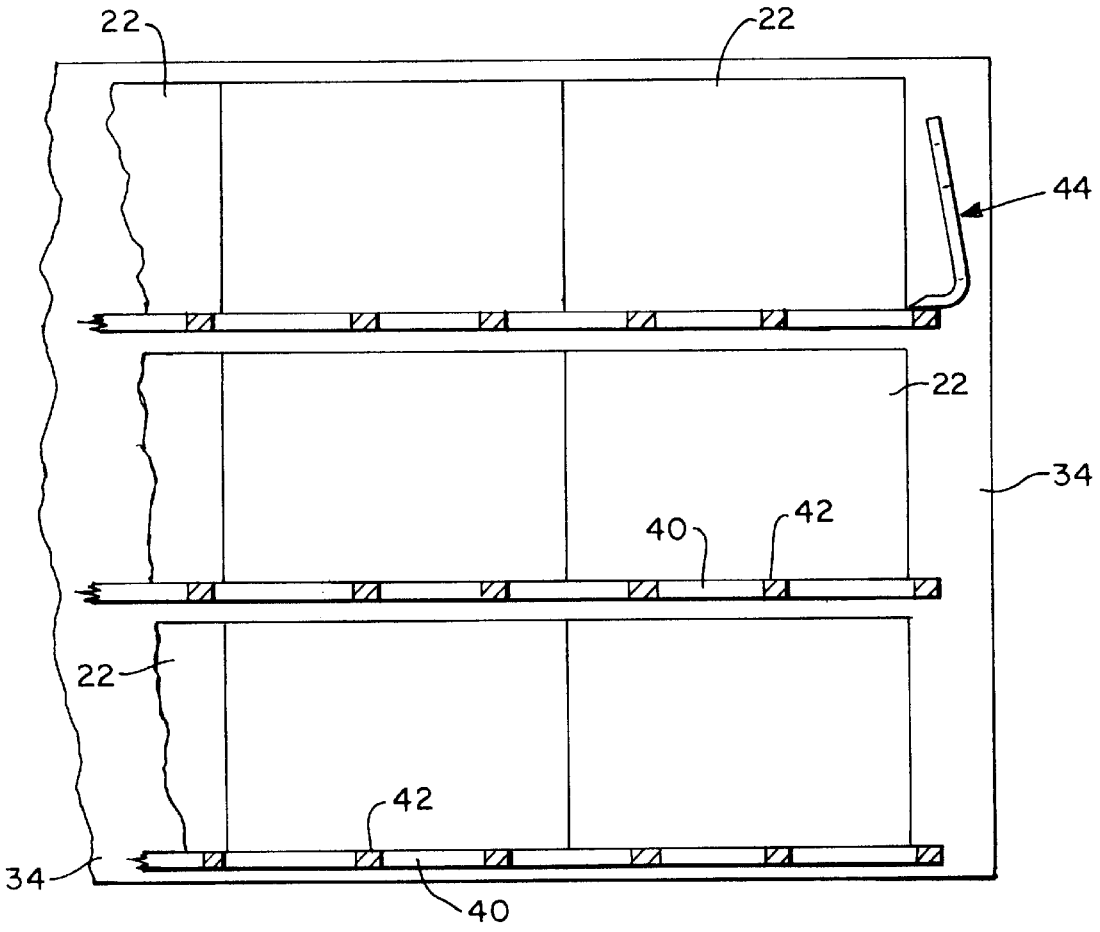
FIG. 4 is a cross section of a portion of the rotor with the baskets in position.

FIG. 3 shows a plan view in cross-section of the same portion of the rotor as in FIG. 2 with the baskets 22 in position and resting on the grating 40 (not shown in FIG. 3). Of course, as is conventional, there would normally be a plurality of layers of gratings and basket modules in each sector as shown in FIG. 4. FIG. 3 illustrates the preferred arrangement in which the basket modules are tapered at an angle which is greater than the angle of taper of the sectors 20. In this regard, see U.S. Pat. No. 5,485,877. The baskets are side installed by pushing them in until the outboard corners contact the diaphragms. The baskets may then be fixed in position by suitably pinning at least the outboard basket to the diaphragms.

Figure 5:
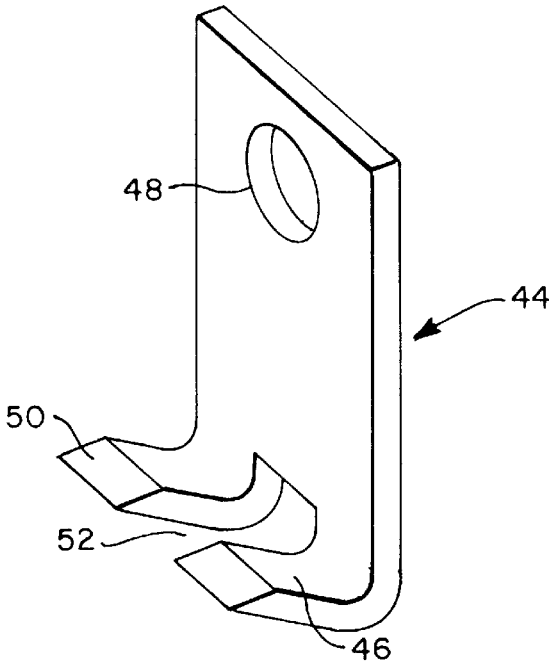
FIG. 5 is an isometric view of the removal lug of the present invention.
Figure 6:
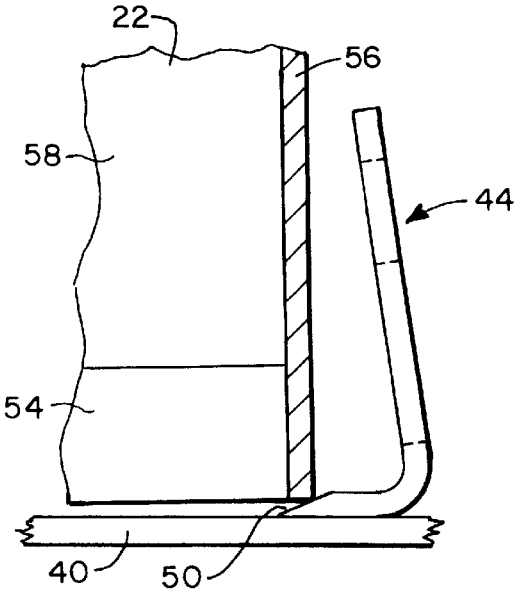
FIGS. 6 and 7 are section views of a portion of a rotor illustrating the use of the removal lug.
Figure 7:
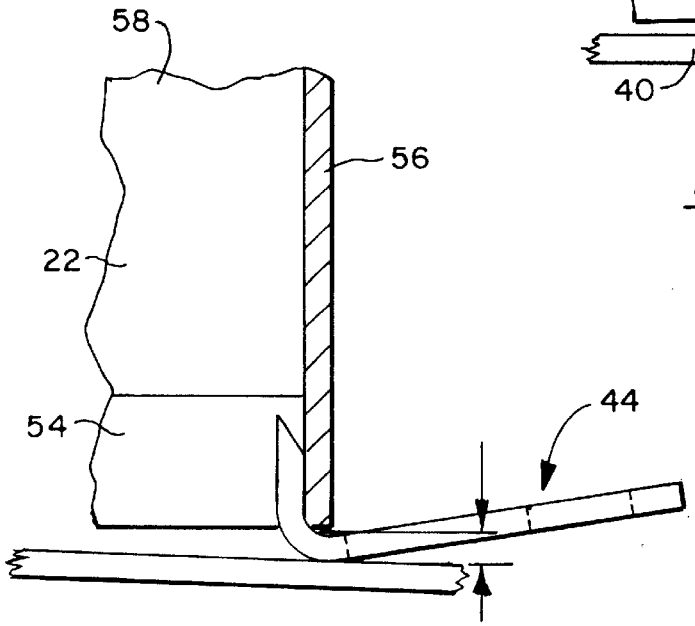

FIG. 4 illustrates a cross section of a portion of the rotor with the heat exchange baskets 22 in position. The baskets 22 are supported on the gratings 40 which are attached to the diaphragms 34, one of which is shown in this FIG. 4. Also shown is the removal lug 44 which is used in the method of the present invention for removing the baskets 22 from the rotor. The removal lug 44 and the removal method involving the use of the lug are more clearly illustrated in FIGS. 5 to 7. As shown in the isometric view of FIG. 5, the removal lug 44 comprises a flat metal plate with a bent hook portion 46 at one end and a hole 48 at the other end for the attachment of a pulling cable. The end of the hook portion 46 is beveled at 50 to form a relatively small, sharp edge for insertion of the removal lug under the baskets 22 as shown in FIG. 6. The removal lug 44 also has a notch 52 in the hook portion 46 which is adapted to fit over or straddle the typical basket holding or tie bars. These tie bars are members which extend radially along the center of the bottom of each basket and which are fastened to the inner and outer ends of the basket. A tie bar 54 is shown in FIGS. 6 and 7 which are a cross section of an outer bottom corner of a basket 22 on a grating 40. The basket comprises the outer end portion 56 of the basket wrapper and the side portion 58 of the basket wrapper. The tie bar 54 is attached to the outer bottom edge of the outer end portion 56. In FIG. 6, the removal lug 44 is shown in position for insertion of the beveled edge 50 under the basket 22. This is usually done by merely hammering on the removal lug. As can be seen in FIG. 6, this starts to lift the outer edge of the basket 22 off of the grating 40. Once the hook portion 46 of the removal lug 44 is inserted a sufficient amount under the basket 22, the removal lug 44 is rotated into the position shown in FIG. 7. Although it cannot be seen, the notch 52 in the removal lug 44 is straddling the tie bar 54. The removal lug 44 is dimensioned, particularly the thickness, such that the distance that the basket 22 is lifted above the grating 40 is less than the amount of free space available on top of the basket. This lifting distance is usually about one quarter inch. When the removal lug 44 is in the position shown in FIG. 7, a cable or other pulling means is attached to the hole 48 and the basket is pulled out of the rotor.

I claim:

1. A method for removing heat exchange baskets radially through the side of the rotor of a rotary regenerative air preheater wherein said baskets are supported on support gratings in said rotor and wherein said baskets have a lower outer edge and wherein said baskets include a member extending across at least said lower outer edge, said method comprising the steps of:

a. providing a removal tool comprising a lever portion and a hook portion, said removal tool including a beveled edge on said hook portion;

b. inserting said beveled edge on said hook portion between one of said baskets and said support grating;

c. forcing said hook portion under said one basket whereby said one basket is lifted above said support grating;

d. rotating said lever portion of said removal tool downward whereby said hook portion engages said member extending across said lower outer edge of said basket; and e. pulling radially outward on said removal tool and thereby removing said basket out from the side of said rotor.

2. A method as recited in claim 1 wherein said removal tool includes a hole in said lever portion and wherein said step of pulling includes the step of attaching a cable to said hole and pulling on said cable.

* * * * *